US007192406B2

(12) United States Patent
Marten

(10) Patent No.: US 7,192,406 B2
(45) Date of Patent: Mar. 20, 2007

(54) FOOT MASSAGER

(76) Inventor: Kirt Marten, N10949 County D, Birnamwood, WI (US) 54515

( * ) Notice: Subject to any disclaimer, the term of this patent is extended or adjusted under 35 U.S.C. 154(b) by 80 days.

(21) Appl. No.: 10/966,990

(22) Filed: Oct. 14, 2004

(65) Prior Publication Data

US 2006/0084893 A1 Apr. 20, 2006

(51) Int. Cl.
*A61H 15/00* (2006.01)

(52) U.S. Cl. ..... 601/127; 601/32

(58) Field of Classification Search ..... 601/37, 601/89, 46, 118, 131–132, 121, 119, 120, 601/115, 117, 122–127, 31–32, 27–28, 128–129, 601/134, 137

See application file for complete search history.

(56) References Cited

U.S. PATENT DOCUMENTS 1,630,911 A * 5/1927 Wentz ..... 601/127
1,710,051 A * 4/1929 Giacopazzi ..... 601/127
2,294,947 A * 9/1942 Andis ..... 601/127
2,521,874 A * 9/1950 Runstedler ..... 601/94
2,534,412 A * 12/1950 Burnett et al. ..... 601/94
2,909,174 A * 10/1959 Heldenbrand ..... 601/127
2,939,455 A * 6/1960 Arnold ..... 601/127
2,976,867 A * 3/1961 Schaeffer ..... 601/127
3,415,514 A * 12/1968 Weihs ..... 482/79
3,468,305 A * 9/1969 Collomp et al. ..... 601/127
3,570,478 A * 3/1971 Schneider ..... 601/127
3,877,422 A * 4/1975 Heuser et al. ..... 601/116
4,127,116 A * 11/1978 Pannetier ..... 601/127
4,198,962 A * 4/1980 McCauley ..... 601/63
4,205,663 A * 6/1980 Fujiwara ..... 601/122
4,577,625 A * 3/1986 Lohati et al. ..... 601/128
4,679,549 A * 7/1987 Quam et al. ..... 601/128
4,782,823 A * 11/1988 Yamasaki ..... 601/127
4,984,569 A * 1/1991 Liu ..... 601/93
5,251,620 A * 10/1993 Boucher et al. ..... 601/122
5,558,625 A * 9/1996 McKay ..... 601/118
5,643,181 A 7/1997 Lin
5,725,484 A * 3/1998 Burnham ..... 601/128
5,830,161 A * 11/1998 Cosmano ..... 601/121
D414,874 S * 10/1999 Edens ..... D24/212
D419,683 S * 1/2000 Miyake ..... D24/213
6,056,709 A * 5/2000 Hashimoto ..... 601/127
6,210,349 B1 * 4/2001 Naruse et al. ..... 601/127
6,306,109 B1 * 10/2001 Polychronis ..... 601/137
6,811,539 B1 * 11/2004 Nguyen ..... 601/31

* cited by examiner

*Primary Examiner*—Michael A. Brown
*Assistant Examiner*—Huong Q. Pham
(74) *Attorney, Agent, or Firm*—Wilhelm Law Service, S.C.; Thomas D. Wilhelm

(57) ABSTRACT

A massage device has a close-packed presenting structure of massage elements, mounted on a working unit. The presenting structure is sufficiently closely packed to prevent insertion of an adult's digit, e.g. finger or toe, into the spaces between respective ones of the massage elements. Such close packing, in a drum-type structure of closely-packed massage elements, prevents a user from accidental injury to his/her fingers or toes if and as the presenting structure is rotating about an axis of rotation. The massage device can have a heel rest, a variable speed drive, and/or a heater which heats the massage elements.

14 Claims, 3 Drawing Sheets

FOOT MASSAGER

BACKGROUND

The present invention relates to devices containing massage elements for therapeutic massage of the sole and foot. Massage is known as a natural method for healing physical conditions as well as for treating stress-related conditions. Massage is one form of reflex therapy. The essence of reflex therapy is stimulation of certain areas of the skin and underlying tissues as a healing treatment. The stimulation can be achieved by massage, pressure, or heat, or a combination of massage and/or pressure and/or heat.

One known type of massage is the massaging of the sole of the foot. The sole of the foot carries a rich sensory nerve network. The central nervous system and internal organs can be influenced by manipulation of this network of sensory nerves.

Sole massage is traditionally practiced by hand massage where the thumb plays a substantial role in manipulating the sole of the foot. Consequently, such massage is quite tiring, and can burden the hand of the massage practitioner, thereby limiting the availability of such treatment, and potentially causing medical damage to the appendages of the practitioner.

In light of the difficulties inherent in the practice of hand massage therapy, various attempts have been made to replace the tiring activity of manual massage with certain devices which facilitate the achievement of the massage experience. And while a variety of devices and methods have been proposed, there is still a need for a massage device which massages primarily the sole areas of the user's foot, and which further facilitates the ease and efficacy of such massage experience.

SUMMARY

The invention generally comprehends a massage device. The massage device has a close-packed presenting structure of massage elements, mounted on a working unit. The presenting structure is sufficiently closely packed to prevent insertion of an adult's digit, e.g. finger or toe, into the spaces between respective ones of the massage elements. Thus, the close packing prevents a user from accidental injury to his/her fingers or toes if, and as, the presenting structure is rotating about an axis of rotation. The massage device can have a heel rest, a variable speed drive, and/or a heater which heats the massage elements.

In a first family of embodiments, the invention comprehends a massage device, comprising a frame, and a working unit supported from the frame and having an axis of rotation. The working unit comprises a presenting structure extending between first and second ends of the working unit, and an array of massage elements supported from the presenting structure. The plurality of massage elements is so collectively arranged and configured on the presenting structure that outer surfaces of the massage elements on adjacent elements of the presenting structure cooperate with each other so as to limit the sizes of spaces between massage elements in the array, to sizes wherein a conventional-size digit of an adult human cannot be easily inserted into such limited-size spacings. This first family of embodiments further comprises a prime mover operatively coupled to the working unit, optionally through a drive train, and driving the working unit about the axis of rotation.

In some embodiments, in operation of the massage device, the massage elements become exposed so as to be available for direct massaging contact with a user of the massage device.

In some embodiments, the massage elements are supported from respective units of the presenting structure, with facile rotation of the massage elements with respect to the respective units of the presenting structure.

In some embodiments, the working unit comprises first and second end elements axially spaced from each other and supporting the working unit from the frame so as to define ends of a generally cylindrical working unit structure, and wherein the presenting structure comprises a plurality of elongate support bars substantially uniformly spaced about the first and second end elements at a common distance from the axis of rotation of the driven working unit, the massage elements being supported from the support bars.

In some embodiments, the invention further comprises a heel rest proximate the working unit, and below the top of the working unit, a tangent to the working unit, which passes across the heel rest proximate a bottom of a heel of a user's foot, resting on the heel rest, defining an angle, with respect to a horizontal underlying support, of about 10 degrees to about 25 degrees.

In some embodiments, the invention further comprises the heel rest, the massage elements being exposed to ambient conditions so as to be available for direct contact with a user of the massage device.

In some embodiments, the invention further comprises the heel rest proximate the working unit, and is devoid of any toe rest whereby, if such toe rest were present, a user could rest a heel of a foot on the heel rest and a toe or ball of such foot on such toe rest while the massage elements massage a portion of such foot between the heel rest and the toe rest.

In some embodiments, the massage elements are periodically exposed to ambient conditions so as to be available for direct massaging contact with a user of the massage device.

In some embodiments, the working unit comprises a plurality of elongate support bars substantially uniformly radially spaced about an axis of rotation of the working unit, wherein a plurality of separate and distinct ones of the massage elements, on a given support bar, are in simultaneous working contact with the foot of the user.

In some embodiments, the massage device further comprises a variable speed drive control, driving speed of rotation of the working unit.

In some embodiments, the linear speed of rotation of the working unit, at massaging contact surfaces of the massage elements, is about 20 linear feet per minute to about 110 linear feet per minute.

In some embodiments, the massage device further comprises a heater proximate the working unit, which heater is effective to heat the massage elements above ambient temperature, whereby the massage elements provide a heated massage effect to the foot of the user.

In some embodiments, the massage elements on a first support bar provide interfering support to respective massage elements on a next adjacent second support bar so as to interfere with axial movement of the massage elements on the second support bar with respect to the second support bar.

In some embodiments, the prime mover causes the working unit to rotate with respect to the frame thereby to massage the foot of a user while the foot is maintained relatively stationary with respect to the massage device.

In some embodiments, the working unit comprises a plurality of elongate support bars substantially uniformly radially spaced about an axis of rotation of the working unit, the plurality of elongate support bars being substantially uniformly spaced about the axis of rotation and at a substantially common distance from the axis of rotation, the massage elements being mounted to the support bars with facile rotation of the massage elements with respect to the support bars, the massage elements being exposed so as to be available for direct massaging contact with a user, and the prime mover driving the working unit, optionally through a drive train, to rotate with respect to the frame thereby to massage a foot of a user while such foot is maintained relatively stationary with respect to the massage device.

In some embodiments, a tangent to the working unit, which passes through the heel rest proximate a bottom of the heel of a user's foot, defines a foot rest angle which facilitates resting a bottom of the user's heel on the heel rest and maintaining the foot stationary with little or no effort on the part of the user to retain the foot on the massage device while the foot is being massaged by the working unit.

In some embodiments, the driving unit drives the working unit such that the massage elements move along a user's foot in a direction from the heel of the user's foot toward the toes of the user's foot.

In a second family of embodiments, the invention comprehends a massage device, comprising a frame; and a working unit having first and second ends, and a first length therebetween. The working unit is supported from the frame. A plurality of massage assemblies are mounted in the working unit. Each massage assembly comprises an elongate support bar having third and fourth ends at corresponding first and second ends of the working unit, and a second length extending between the third and fourth ends. An array of massage elements is assembled to the elongate support bar in each massage assembly, including first and second ones of the massage elements on opposing ends of the array. The massage elements on a first such elongate support bar provide interfering support to respective massage elements on a next adjacent second support bar so as to interfere with axial movement of the massage elements on the second support bar with respect to the second support bar.

In some embodiments, the massage elements on the second support bar are confined against substantial movement of the massage elements along the length of the second support bar by the combination of the interference against axial movement imposed by (i) the massage elements of the first support bar, (ii) abutment of the first end massage element on the second support bar with respect to one of the first and second end elements, and (iii) spacing of the second end massage element of the second support bar from the second end element of the working unit.

In some embodiments, a plurality of separate and distinct ones of the massage elements, on a given support bar, are in simultaneous working contact with the foot of a user.

In a third family of embodiments, the invention comprehends a massage device, comprising a frame, and a working unit supported from the frame. The working unit comprises presenting structure extending between first and second ends of the working unit, an array of massage elements supported from the presenting structure, with facile rotation of the massage elements with respect to the presenting structure, and a heel rest proximate the working unit. The massage elements are exposed to ambient conditions so as to be available for direct rolling contact with a user of the massage device.

In some embodiments, the heel rest, in combination with the working unit, defines a working locus which supports a user's foot being massaged, and defines a general angle of the foot with respect to an underlying support, the massage device further comprising angular adjustment structure, such as a slot and peg bracket, enabling adjustment of the height of at least one of the working unit, and the heel support or cover, so as to adjust the general angle of the foot with respect to the underlying support.

In a fourth family of embodiments, the invention comprehends a massage device, comprising a frame, and a working unit supported from the frame and having an axis of rotation. The working unit comprises a presenting structure extending between first and second ends of the working unit, and an array of massage elements supported from the presenting structure. The invention further comprehends a prime mover operatively coupled to the working unit and driving the working unit, optionally through a drive train, about the axis of rotation; and a variable speed drive control operative to enable a user of the massage device to vary speed of rotation of the working unit about the axis of rotation as driven by the prime mover.

In a fifth family of embodiments, the invention comprehends a massage device, comprising a frame, and a working unit supported from the frame and having an axis of rotation. The working unit comprises a presenting structure extending between first and second ends of the working unit, and an array of massage elements supported from the presenting structure. The invention further comprises a prime mover operatively coupled to the working unit and driving the working unit about the axis of rotation, and a heater proximate the working unit. The heater is effective to heat the massage elements above ambient temperature, whereby the massage elements provide a heated massage effect to a foot of a user of the massage device.

Figure 1:
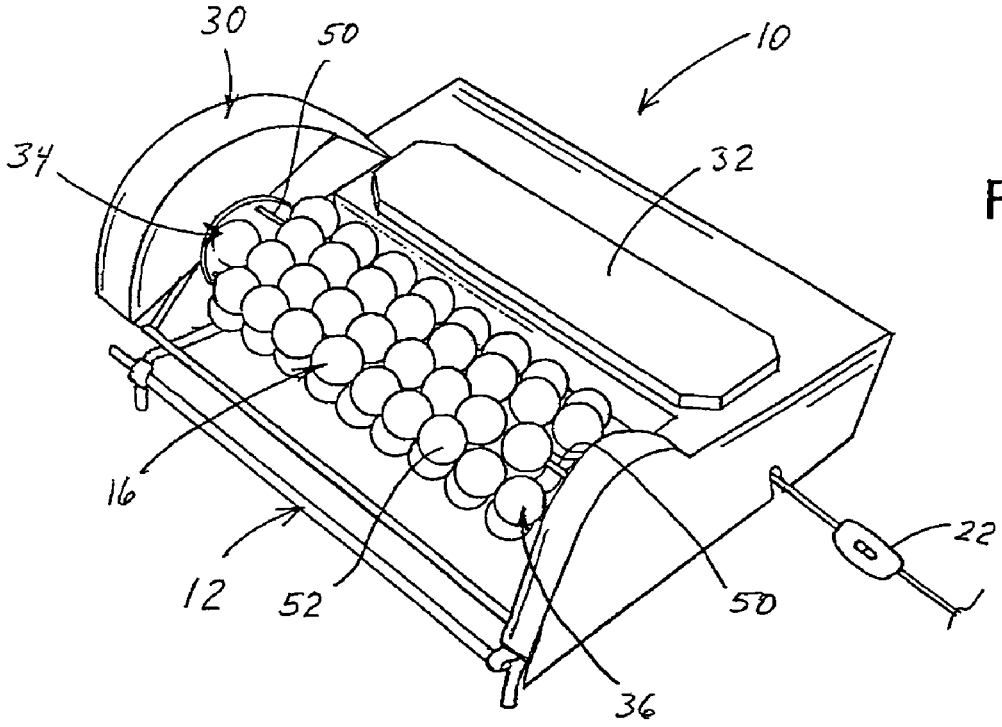
FIG. 1 shows a generally rearwardly-facing pictorial view of a massage device of the invention.
Figure 2:
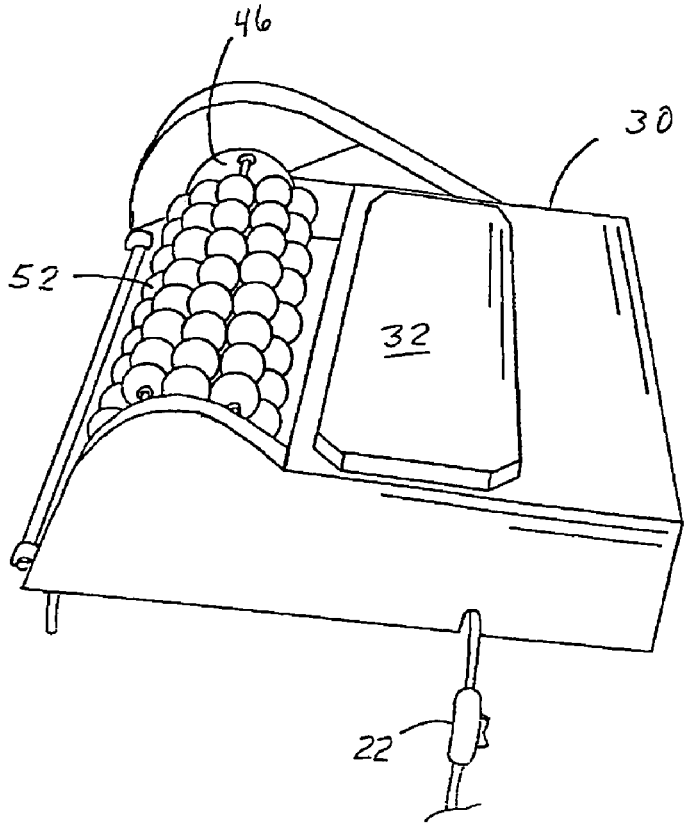
FIG. 2 shows a side-facing pictorial view of the massage device of FIG. 1.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE ILLUSTRATED EMBODIMENTS

Referring to the drawings, the invention comprehends a massage device 10, generally comprised of a frame 12 and an operating core 14. In the embodiments illustrated in FIGS. 1–5, the operating core includes a working unit 16, a prime mover 18 such as an electric motor, and a drive train 20 between the prime mover and the working unit. The prime mover 18 generally drives the working unit, through the drive train.

A switch 22 provides access to power, through e.g. wires connected to the national electrical grid, to drive the prime mover. Prime mover 18 can be controlled by switch 22 with respect to varying the speed of the output of the prime mover. In the alternative, an e.g. electronic motor control 24 can be used in combination with prime mover 18 and switch 22 to control the speed of rotation of the output shaft of the prime mover.

In the illustrated embodiment, a gearbox 26 or other speed change device, and optionally one or more drive belts 28, are employed to facilitate achieving the desired driven speed of rotation of the working unit. In the alternative, any of a number of known types of drive train configurations can be used in place of the specific structures shown for drive train 20, for example a direct drive where the output shaft of prime mover 18 is directly coupled to shaft 42 or other drive structure of working unit 16.

A cover 30 generally overlies the operating core while leaving the working unit exposed for interaction with the user of the massage device. An e.g. cushioned heel rest 32 is disposed on the top surface of cover 30 adjacent working unit 16.

Heel rest 32 can be made from a wide variety of materials, devised in a wide variety of structures. Typically, heel rest 32 includes an internal cushioning core such as a batt of cellulosic or nylon or other natural or synthetic fibers fabricated in a closely packed or inter-related arrangement so as to provide a cushioning effect. Such core is overlaid by an outer cover, which is typically any of a wide variety of sheet materials which can be mounted over the core, or a coating applied directly to the core. In the alternative, the heel rest can be fabricated from e.g. a foam core, and covered with either a sheet material or a coating applied directly to the core. In any event, and whatever the construction of the heel rest, the heel rest provides a comfortable place for the user to rest the heel of his/her foot while using the massage device of the invention. The outer surface of the cover typically has a coefficient of friction, relative to the skin of the user's foot, which tends to resist sliding movement of the foot along the surface of the cover. At the same time, the surface of the cover is comfortable, not harsh or scratchy, desirably pleasant to the touch, thus to facilitate extended periods of use of the heel rest and the massage device.

Working unit 16 generally comprises a driving end 34 and a driven end 36. Driving end 34 is mounted to frame 12 for rotation with respect to the frame, and is driven by driving force received from the prime mover, through drive train 20.

Driven end 36 is mounted to frame 12 for rotation with respect to the frame, and rotates according to the driving force received from the prime mover through driving end 34 and drive train 20.

The driving end 34 is connected to prime mover 18 through drive train 20, thereby to drive rotation of the working unit. Collectively, the mounting of the driving end and the driven end, both to the frame, facilitates rotation of the working unit with respect to frame 12.

As illustrated in the drawings, working unit 16 is suspended from frame 12, through bearings 38 and 40 by respective first and second shafts 42 and 44 at the driving end 34 and the driven end 36, respectively.

Shaft 42 at driving end 34 is mounted to a first end element, for example end disc 46. Shaft 44 at driven end 36 is mounted to a second end element, for example end disc 48. End disc 46 at the driving end, and end disc 48 at the driven end, are axially spaced from each other, and are generally parallel with respect to each other.

The working unit includes presenting structure, such as a plurality of elongate support bars 50 which extend between, and are supported from, end discs 46 and 48, thereby connecting the end discs to each other for common rotation of the driven discs and the support bars. Support bars 50 transmit the rotational force applied at driven disc 46 through the working unit to driven disc 48.

A plurality of massage elements, such as massaging spheres 52, are mounted in serial relationship along the length of each of support bars 50, and in rolling engagement with the bars to which they are mounted, thus to make a support bar subassembly. In the embodiments illustrated, the massage elements are mounted to the support bars in surface-to-surface contact with each other adjacent the locus of the respective support bar. A given massage element, e.g. sphere, can be mounted to the respective bar, with the bar extending through an aperture, hole, in the sphere.

In the alternative, the sphere can include a bearing-type arrangement and the bar is mounted to the bearing such that the bearing facilitates relatively free rotation of the sphere relative to the bar. As another alternative, adjacent spheres can be journalled with respect to each other on respective bearings, and/or on some structure, such as a rod, which connects such bearings and/or such spheres. Where the bar passes through all of the spheres which are mounted to that respective bar, as a continuous bar, the bar can be a single-piece bar. Where the bar does not pass through all of the spheres, e.g. is mounted through bearing-type structures to the spheres, a bar 50 can be defined by a multiplicity of bar elements which collectively, in combination with the respective spheres and/or bearings on that support bar, extend between end discs 46 and 48. Whatever the structure of the bars, whatever the interfacing used between the bar and the working elements, the working elements/spheres typically rotate relatively freely relative to the bar or bar elements, and rotate freely in respect to each other. In some instances, one or more of the working elements 52 can be ganged together so as to rotate in unison. However, the working elements on any one support bar assembly 53 contribute at least two separate and distinct rotating working element structures which freely rotate independent of each other.

The arrangement of the bars on each of end discs 46 and 48, e.g. about the circumferences of the end discs, is such as to enable mounting the massage elements on the support bars in a self-aligning, close packing arrangement. In the illustrated embodiments, eight support bars 50A, 50B, 50C, 50D, 50E, 50F, 50G, 50H, are mounted in a circular array about the circumferences of end discs 46 and 48 so as to define a cylindrical framework which receives the massage elements/spheres.

As a first expression of close packing, massage elements 52 are mounted to a given support bar in surface-to-surface contact with each other. Namely, each massage element is in contact, e.g. closely packing contact, with the next adjacent ones of the massage elements along the length of the respective bar.

As a second expression of close packing, the support bars 50 are spaced about the circumference of the end discs 46 and 48 such that the massage elements of a first support bar are in near-surface-to-surface contact with respective ones of the massage elements of the next adjacent support bar about the circumferences of the end discs. Thus, the massage elements mounted on support bar 50B are in near-surface-to-surface contact with respective ones of the massage elements of support bar 50A.

Figure 4:
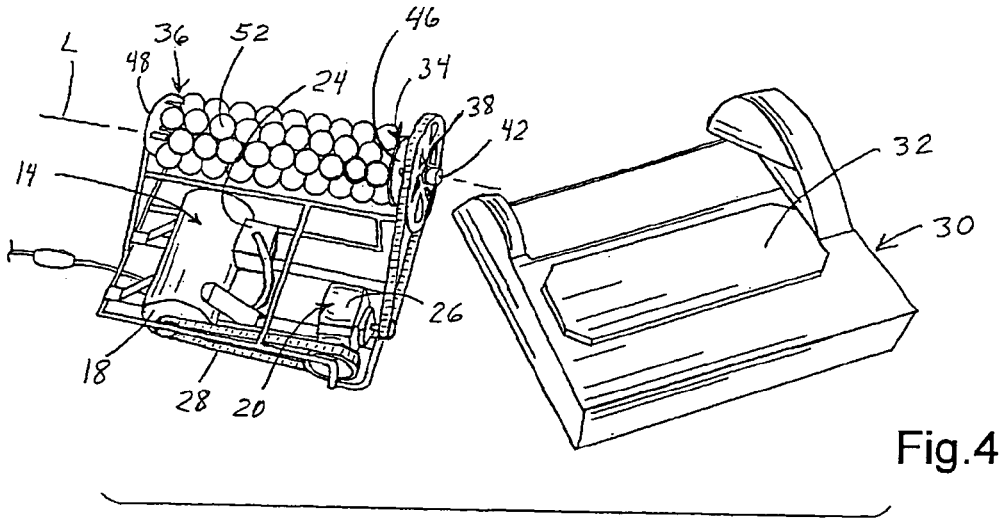
FIG. 4 shows a generally forwardly-facing pictorial view of the massage device of FIGS. 1–3, with the cover removed and placed beside the operating core.
Figure 5:
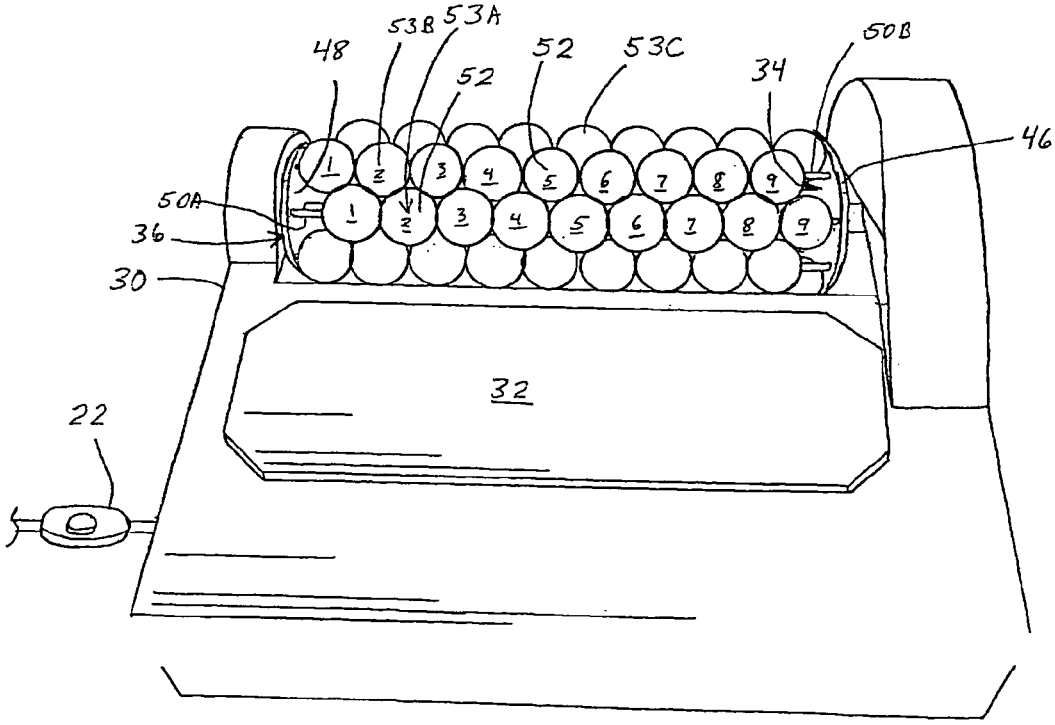
FIG. 5 shows a generally forward-facing pictorial view of the massage device of FIGS. 1–4.

Referring e.g. to FIGS. 4 and 5, the locations of the centers of the spheres on support bar 50B are staggered along the length of the working unit, e.g. along the length of support bar 50B, between the centers of respective ones of the spheres which are mounted on support bar 50A. The result of the staggering of the spheres on alternate ones of the support bars, in combination with selecting size of the spheres and designing the distances between support bars 50 on end discs 46 and 48, is that the spheres on a first support bar 50A can be seen to nest in the recesses 54 which naturally exist between respective ones of the spheres on a second support bar 50B, thus minimizing the sizes of the spaces between adjacent ones of the spheres on working unit 16.

Stated another way, a plurality of massaging spheres 52 is arranged along the length of each support bar 50, thus to define a support bar assembly 53. Adjacent the support bar, respective ones of the massaging spheres are in generally facing and abutting relationship with respect to each other. At locations displaced away from the support bar, corresponding surfaces of the adjacent ones of the massaging spheres are displaced from each other, thus defining the recesses 54 which exist between the respective adjacent spheres on a given support bar. Accordingly, the massaging spheres on a given support bar define a plurality of recesses 54 along the length of the respective support bar assembly 53, namely a recess 54 between each two adjacent spheres.

Recesses 54 are evenly spaced along the length of each of the support bar assemblies in accord with the common sizes and configurations of the respective spheres on that support bar. In the illustrated embodiments, the recesses along a given support bar assembly thus have common sizes and configurations as defined by the respective spheres 52. Accordingly, each of the recesses defined by a given support bar assembly 53 have a common size and a common configuration.

A given recess 54 is a three-dimensional space extending about two adjacent spheres, and extending between the maximum diameters of the two spheres and transverse to the respective support bar, and the loci where the two spheres come together adjacent the respective support bar.

The spheres in a given support bar assembly 53 thus extend in a somewhat undulating pattern along the length of the respective support bar assembly, thereby defining the recesses between the maximum diameters of adjacent ones of the spheres when considered parallel to the support bar. Each support bar assembly 53 thus defines a series of maximum diameters spaced along the length of the support bar assembly between respective ones of recesses 54.

Given a first such set of spheres on a first one of the support bars 50A, the next adjacent second set of spheres on the next adjacent second one of the support bars 50B is positioned such that sequential maximum diameter portions of the second set of spheres nests in, is received in, the recesses in the first set of spheres, generally filling each of the recesses between the adjacent sets of spheres. Eight such support bar assemblies 53 are shown in the illustrated embodiments. The eight such support bar assemblies thus comprise an array of massaging spheres which generally defines an imaginary cylindrical working surface having, as its outer perimeter, those portions of the respective spheres which are most displaced from axis of rotation "L" of such imaginary cylinder.

With recesses 54 of a given support bar assembly 53 generally filled in by spheres of adjacent support bar assemblies, the spaces 56 between spheres in the array, which permit ingress into, or egress from, the inner volume defined inside the working unit, e.g. adjacent axis of rotation "L", are thus limited, in size and configuration, according to the intrusions, filling in, of respective ones of the spheres into the adjacent recesses. Spaces 56 are thus so limited in size that a conventional-size digit of an adult human cannot be easily inserted into such limited-size spaces.

Referring to FIG. 5, a first support bar assembly 53A and a second support bar assembly 53B are specifically enumerated. In support bar assembly 53A, each of the spheres is enumerated in order from the left end of the support bar 50A to the right end of support bar 50A, as 1, 2, 3, 4, 5, 6, 7, 8, and 9. FIG. 5 illustrates that sphere 9 of support bar assembly 53A is prevented, by end disc 46, from moving to the right of its illustrated position. Sphere 1 of support bar assembly 53B is prevented, by end disc 48, from moving to the left of its illustrated position.

Given the limitation that sphere 9 of assembly 53A cannot move to the right, given the general abutting relationship between sphere 9 and sphere 8 of assembly 53A, sphere 9 provides interfering support and prevents sphere 8 from moving axially on the support bar to the right of its illustrated position. Given the general abutting relationship between spheres 7 and 8 of assembly 53A, sphere 8 provides interfering support and prevents sphere 7 from moving axially on the support bar to the right of its illustrated position. Given the general abutting relationship between spheres 6 and 7 of assembly 53A, sphere 7 provides interfering support and prevents sphere 6 from moving axially on the support bar to the right of its illustrated position. And so, each of the spheres, 5, 4, 3, 2, 1, is provided with interfering support and prevented from moving axially on the support bar to the right of its illustrated position, by the sphere to its right.

Given the limitation that sphere 1 of assembly 53B is provided with interfering support and prevented, by end disc 48, from moving axially on the support bar to the left of its illustrated position, given the general abutting relationship between sphere 1 and sphere 2 of assembly 53B, sphere 1 provides interfering support and prevents sphere 2 from moving axially on the support bar to the left of its illustrated position. Given the general abutting relationship between spheres 2 and 3 of assembly 53A, sphere 2 provides interfering support and prevents sphere 3 from moving axially along the support bar to the left of its illustrated position. Given the general abutting relationship between spheres 3 and 4 of assembly 53B, sphere 3 provides interfering support and prevents sphere 4 from moving axially along the support bar to the left of its illustrated position. And so, each of the spheres, 5, 6, 7, 8, and 9 is provided with interfering support and prevented from moving axially along the support bar to the left of its illustrated position by the sphere to its left.

In light of the above discussion of support bar assemblies 53A and 53B, and given the nesting of the spheres of support bar assemblies 53A and 53B each in the recesses of the other, the spheres in support bar assemblies 53A and 53B collectively prevent each other from moving either to the left or the right when assembled in the working unit. Similarly, the spheres in assemblies 53B and 53C collectively prevent each other from moving either to the left or the right along the respective support bars. And so on around the circumference of the working unit of 8 support bars, each bearing a plurality of spheres, with the spheres on each of the support bars nesting in the recesses in the support bar assemblies on either circumferential side, relative to working unit 16, of the respective support bar.

All of the support bar assemblies collectively define a presenting structure, which presents the full array of massaging elements to the user as the working unit rotates about axis of rotation "L".

The number of support bars, in combination with the sizes and numbers of spheres, can be varied according to need of the specific design. In the illustrated embodiment, eight support bars are used, and each support bar bears 9 working elements in the form of spheres.

Working elements 54 can have any of a wide variety of designs, including a substantial variety selected from working elements known in the art. Working elements can be characterized by shape and/or material. Referring first to material, any non-toxic material which will withstand the working environment of pressure, force, and the like, can be used. There can be mentioned, for example and without limitation, wood, plastics, metals, composite materials, and the like.

Regarding shape, there can be mentioned balls, cylinders and cylinder derivatives, ovals, and a wide variety of curvilinear as well as angularly-shaped structures. The common feature of all such working elements is that the elements collectively fill recesses in the presenting structure array to the extent that spaces between the working elements are sufficiently small to prevent the above-mentioned insertion of an adult's digit. Thus, a notable feature of some embodiments of the invention is the combination of a rotating working unit which prevents entry of a person's digit, thus providing a built-in safety feature protective of the user's digits.

Figure 6:
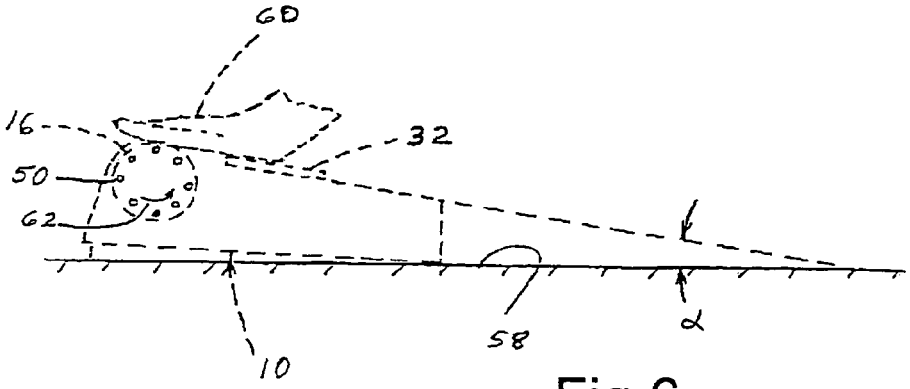
FIG. 6 shows, in dashed-line representation, a side elevation of a massage device of the invention, illustrating a representative angle of a user's foot relative to an underlying support surface such as a floor, when using the massage device.

FIG. 6 illustrates a side elevation of the massage device of the invention, showing a typical angle $\alpha$ between the floor or other underlying support 58 and a user's foot 60. FIG. 6 also shows the direction of rotation of the working unit at arrow 62. Angle $\alpha$ is generally defined across the top of heel rest 32 and on to the tops, e.g. contacting surfaces, of the working elements 52 on 25 working unit 16.

The magnitude of angle $\alpha$ is typically between about 10 degrees and about 25 degrees, optionally between about 10 degrees and about 20 degrees, still further optionally between about 10 degrees and about 15 degrees. Such angles facilitate stabilizing the user's foot while experiencing the movement, and drag forces, of rotation of working unit 16.

Given the arrangement and structure of the massage device of the invention, a number of factors work together to stabilize the foot on the massage device with little or no effort on the part of the user. A first factor is the weight of the user's leg and foot on the heel rest. Such weight, in combination with friction of e.g. a polymeric surface tends to stabilize the foot on the heel rest. Second, by defining angle $\alpha$ to position the foot in an ascending orientation toward the toes, the draw/drag of the working elements on the foot, by rotation of the working unit, which tends to lift the foot, is counteracted by the force of gravity acting on the foot and leg, and acting through angle $\alpha$, which tends to urge the foot downward. In addition, the inherent resistance of the leg to being pulled away from the body tends to hold the foot in a relatively stationary condition, with little or no muscular activity required of the leg muscles of the user. Still further, the relatively free, facile, rotation of the massaging elements on bars 50 provides rolling contact between the massaging elements and the user's foot.

Finally, with the massage elements closely spaced, closely packed together, the user's foot is in simultaneous contact, or nearly simultaneous contact, with a plurality of the massage elements. The overall impact on the foot is one of generally uniform underlying support, even as the working unit is sequentially rotating ones of the massage elements into contact with the foot and out of contact with the foot, whereby the presenting structure provides an ongoing sequence of multiple ones of the massage elements coming into contact with the user's foot at any given time, and subsequently moving out of contact with the user's foot as others of the massage elements move into such massaging contact. Thus, the working unit brings multiple massage elements into rolling contact with the area of the foot being treated, and then causing those massage elements to roll out of contact with the area of the foot being treated as others of the massage elements are being brought into such rolling and massaging contact.

Thus, the drag, the force with which the rotation of the working unit pulls the user's foot in the direction of the toes, is relatively small compared to the mass of the user's foot and leg. The amount of drag force is, of course, proportional to the amount of e.g. force by which the user urges his/her foot downwardly against the rotating working unit.

The user can elect a gentle massage by urging the contact portion of the foot gently against the rotating massage elements. A moderate level of massage can be achieved by the user applying a moderate level of force between the foot and the rotating massage elements. A robust and vigorous massage can be achieved by the user urging the foot forcefully downward against the rotating massage elements. The heel of the user's foot can be urged downwardly on the heel rest with any desired amount of force in order to better stabilize the user's foot on the massage device for the duration of the massage. The user can, on the other hand, vary the intensity of the massage experience as desired by dynamically varying the force being applied between the foot and the working elements.

The intensity of the massage experience can also be varied by adjusting the drive rate of the working unit. The drive rate can be affected by providing, a variable speed drive to pulley 14. Such variable speed drive can be provided by varying the power input to motor 18 e.g. through a variable capability in switch 22. In the alternative, or in combination, an electronic motor control 24 can be provided whereby the speed of motor 18 is controlled by solid state electronics, e.g. a speed control circuit.

If desired, the speed can be pre-set to vary from time to time, such as to speed up and/or then to slow down, with optional constant speed increments and/or timed stops, according to any desired sequence of speed-related events. The speed sequences can be selected before the beginning of a massage treatment, or in real time during a massage treatment, to any of a variety of pre-programmed speed sequences. In such case, motor control 24 takes on the form of an e.g. digital computer having suitable memory, optionally suitable programming capabilities, optionally suitable input and output devices, all well known in the art, to receive such instructions and to output suitable commands for control of motor 18. In such case, motor 18 can be, for example and without limitation, a servo motor, a stepper motor, or the like. Such motors, such motor controls, such computers, are well known in the art and so are not further described here.

In general, but without limitation, in a constant speed operation, the speed of rotation of the working unit is such that the contacting surfaces of the massage elements pass the surface of the foot being worked at a rate of about 20 linear feet per minute to about 110 linear feet per minute.

For example, when the effective outer circumference of the working unit as defined by massage elements 52 is about 16 inches, a corresponding angular speed of rotation is about 15 revolutions per minute (rpm) to about 80 rpm. An optional angular speed of about 25 rpm to about 60 rpm is desired by some users with about 35 rpm to about 45 rpm being commonly selected by users. The specific desired speed is typically a user preference selection.

The speed of the working unit, where variable speed drive is included, is adjusted according to the intensity of the hits, impacts, being applied by the contacting surfaces of the massage elements against the foot of the user, and by user preference. Intensity, impacts of the hits is a function, among others, of heights of the contact surfaces above the unfilled portions of the recesses, the hardnesses of the surfaces of the massage elements, any contortions or roughness of the surface of a massage element, namely any touch sensation which may result from the surface characteristic of a massage element. Thus, both the structure and surface characteristics of the massage elements can affect desired speed of rotation, and all such adjustment characteristics are included in the claims which follow where such adjustment characteristics are not otherwise limited by recitation of speed.

Given the stability of the foot according to its resting on heel rest 32, given the contributing stabilizing factor of angle $\alpha$, given the low level of drag between the massaging elements 52 and the user's foot, the foot is quite stable on the heel rest while being massaged, with little tendency to move in the direction toward or away from the toes of the foot. Since the foot is thus stable on the massage device, there is typically no need for any toe rest structure. Rather, since the working unit is a relatively open structure, such that a large portion of the collective outer surface of the array of massaging elements can be accessed by the user while the massage device is in operation, the user can specifically extend and/or flex the toes of the foot being massaged, can curl the toes of the foot relatively downward such that the bottoms of the toes generally follow the curvature of the circumference of the working core. Thus, the toes can be generally wrapped in the curvature of the working core whereby the toes can be massaged at the same time as a portion of the foot to the rear of the toes. Such massaging of the toes can be achieved with little or no risk of getting a toe lodged in the rotating array of massage elements, or lodged between the massage elements and a toe rest, and thus injured by the rotating array, since spaces 56 substantially fill recesses 54 whereby there simply is no room for the toes to be inserted into spaces 56 and no toe rest is present. Further, the foot can be positioned such that only the toes are massaged.

A heater 64 can be employed along the surface of working unit 16 to heat spheres 52, so as to apply heat along with the massage experience. Heater 64 optionally provides sufficient heat to raise the surface temperatures of the massaging spheres above normal body temperature, so as to provide a sensation to the user that his/her foot is being heated as it is being massaged. Typical of comfortable such temperatures is about 100 degrees F. to about 110 degrees F. Cooler or warmer temperatures can be employed as desired.

Figure 3:
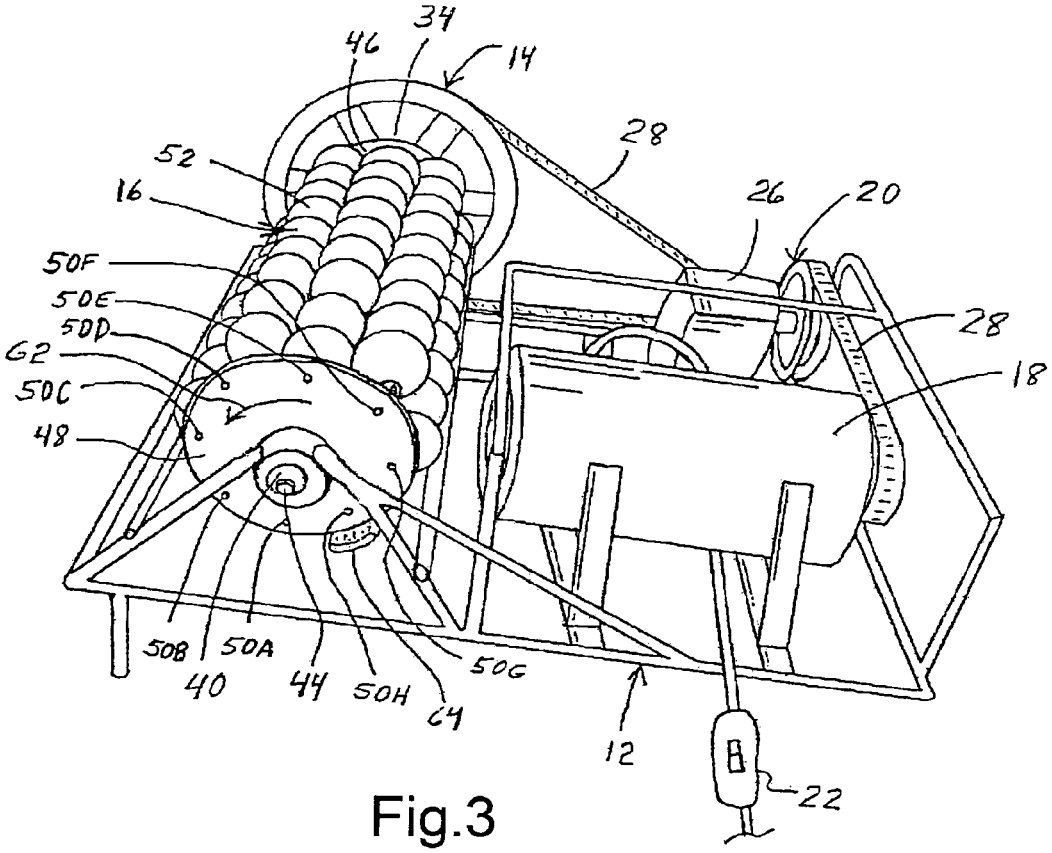
FIG. 3 shows a side-facing pictorial view of the massage device of FIGS. 1 and 2, with the cover removed.

Heater 64, shown in FIG. 3, can be energized from switch 22 in a parallel feed from e.g. motor control 24, such that heater 64 is energized only when working unit 16 is rotating. Suitable shielding is used between heating elements of heater 64 and the bottom of the massage device, so as to avoid overheating underlying surface 58, e.g. the floor.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A massage device, comprising:

(a) a frame;

(b) a working unit having a first end element and a second end element, said working unit being supported from said frame and having an axis of rotation, said working unit comprising (i) a plurality of elongate support bars, having lengths, and extending between the first and second end elements of said working unit, and being substantially uniformly radially spaced about the axis of rotation of said working unit, and (ii) an array of massage elements, each of said massage elements being a separate and distinct rotating sphere and being mounted to the respective said support bar with facile individual rotation of said massage element with respect to said support bar, said massage elements being exposed to ambient air so as to be available for direct massaging contact with a user, and (iii) said elongate support bars being closely spaced from each other and said spheres being closely spaced with respect to each other on said elongate support bars so that outer surfaces of said spheres on adjacent elongate support bars cooperate with each other so as to limit sizes of resultant spaces defined between respective said massage elements in adjacent ones of the arrays, to sizes wherein a conventional-size digit of an adult human cannot be easily inserted into such limited-size spacings;

(c) a prime mover operatively coupled to said working unit and driving said working unit about the axis of rotation, said prime mover driving said working unit to rotate said working unit with respect to said frame;

(d) a heel rest proximate said working unit, and below a top of said working unit; and (e) a heater proximate said working unit, said heater being effective to apply heat to outer surfaces of said spheres.

2. A massage device as in claim 1, a tangent to said working unit, which passes across said heel rest, and which extends generally parallel to a top surface of said heel rest, defining an angle $\alpha$, with respect to an underlying support underlying said massage device, of about 10 degrees to about 25 degrees, an outer surface of said heel rest having a coefficient of friction, relative to skin of a user's foot, which together with a weight of an adult such user's foot, and in cooperation with such angle $\alpha$, and a speed of rotation of said working unit of about 25 rpm to about 160 rpm, tends to stabilize such user's foot on said heel rest, thereby to maintain such foot stationary on said heel rest with little or no effort on the part of such user to retain such foot on said massage device while such foot is being massaged by said working unit.

3. A massage device as in claim 1, said heel rest being devoid of any toe rest whereby a user could rest a heel of a foot on said heel rest and a toe or ball of such foot on such toe rest while said massage elements massage a portion of such foot between the heel rest and the toe rest.

4. A massage device as in claim 1, wherein a plurality of separate and distinct ones of said massage elements, on a given support bar, are in simultaneous working contact with a foot of a user.

5. A massage device as in claim 1, further comprising a variable speed drive control, driving speed of rotation of said working unit.

6. A massage device as in claim 5 wherein linear speed of rotation of said working unit, at massaging contact surfaces of said massage elements, is about 20 linear feet per minute to about 110 linear feet per minute.

7. A massage device as in claim 1 wherein linear speed of rotation of said working unit, at massaging contact surfaces of said massage elements, is about 40 linear feet per minute to about 110 linear feet per minute.

8. A massage device as in claim 1, comprising a plurality of said massage elements on a first said support bar, providing interfering support to respective massage elements on a next adjacent second support bar so as to interfere with axial movement of said massage elements on said second support bar with respect to said second support bar.

9. A massage device as in claim 1 wherein said prime mover causes said working unit to rotate with respect to said frame thereby to massage a foot of a user while such foot is maintained relatively stationary with respect to said massage device.

10. A massage device as in claim 1, a tangent to said working unit, which extends generally parallel to a top surface of said heel rest, defines a foot rest angle $\alpha$ which facilitates resting a bottom of a user's heel on said heel rest and maintaining such foot stationary with little or no effort on the part of the user to retain such foot on said massage device while such foot is being massaged by said working unit.

11. A massage device as in claim 10, said prime mover driving said working unit such that said massage elements move along a user's foot in a direction from a heel of such user's foot toward toes of such user's foot.

12. A massage device as in claim 8, said plurality of massage elements on said second support bar being confined against substantial movement of said massage elements along the length of said second support bar by the combination of (i) interference against axial movement imposed by the massage elements on the first support bar, and (ii) abutment of a first end massage element on said second support bar with respect to one of said first and second end elements.

13. A massage device as in claim 1 wherein linear speed of rotation of said working unit, at massaging contact surfaces of said massage elements, is about 20 linear feet per minute to about 110 linear feet per minute.

14. A massage device as in claim 1, further comprising an electronic speed control circuit coupled to said prime mover, and operative to enable a user of said massage device to vary speed of rotation of said working unit about the axis of rotation as driven by said prime mover.

* * * * *